US005809665A

United States Patent [19]

Suenaga

[11] Patent Number: 5,809,665

[45] Date of Patent: Sep. 22, 1998

[54] INSOLE OF SHOE FOR REDUCING SHOCK AND HUMIDITY

[75] Inventor: Tatsuhiko Suenaga, Tokyo, Japan

[73] Assignee: Go Big Corporation, Tokyo, Japan

[21] Appl. No.: 923,967

[22] Filed: Sep. 5, 1997

Related U.S. Application Data

[63] Continuation of Ser. No. 447,553, May 23, 1995, abandoned.

[30] Foreign Application Priority Data

Apr. 10, 1995 [JP] Japan ..... 7-109111

[51] Int. Cl.[6] ..... A43B 13/38; A43B 7/06

[52] U.S. Cl. ..... 36/43; 36/3 B

[58] Field of Search ..... 36/28, 29, 3 R, 36/3 A, 3 B, 43, 44

[56] References Cited

U.S. PATENT DOCUMENTS

| | | | |
|---|---|---|---|
| 4,215,492 | 8/1980 | Sandmeier | 36/3 B X |
| 4,619,055 | 10/1986 | Davidson | 36/44 X |
| 4,776,110 | 10/1988 | Shiang | 36/3 B |
| 5,010,661 | 4/1991 | Chu | 36/3 B |
| 5,068,983 | 12/1991 | Marc | 36/43 X |
| 5,488,786 | 2/1996 | Ratay | 36/44 |
| 5,675,914 | 10/1997 | Cintron | 36/3 R X |

FOREIGN PATENT DOCUMENTS

| | | | |
|---|---|---|---|
| 1007669 | 2/1957 | Germany | 36/3 B |
| 378842 | 2/1940 | Italy | 36/3 B |
| 272882 | 2/1951 | Switzerland | 36/3 B |
| 2271710 | 4/1994 | United Kingdom | 36/3 B |

*Primary Examiner*—B. C. Dayoan
*Attorney, Agent, or Firm*—Oliff & Berridge, PLC

[57] ABSTRACT

An insole for a shoe is made of a resin having elasticity. The thickness of the insole increases gradually from the portion corresponding to the arch of the foot toward the heel portion to give a slope on the insole. In the bottom of the insole, corresponding to the slope, a recess is provided and ventilation holes are pierced between the recess and the upper surface of the insole. Other ventilation holes are provided through the insole in the area from a toetip to the arch of the foot portion and are connected to the recess through grooves provided in the bottom surface of the insole.

5 Claims, 3 Drawing Sheets

INSOLE OF SHOE FOR REDUCING SHOCK AND HUMIDITY

This is a continuation of application Ser. No. 08/447,553 filed May 23, 1995 now abandoned.

BACKGROUND OF THE INVENTION

1. Field of the Invention

The present invention relates to an improvement in the structure of an insole of a shoe, in particular to an insole which has a structure designed to buffer or absorb shocks generated during walking or running and reduce humidity inside the shoe.

In the present invention, the concept of an insole is used to mean that which is separately inserted in any shoe in order to regulate the comfort of wearing the shoe.

2. Description of the Prior Art

Buffering shock to the feet generated by "normal" walking while commuting or shopping, jogging to promote health, walking for the training or rehabilitation of persons suffering from injuries or handicaps, or the like (hereinafter referred to simply as "walking"), and to reduce injury brought about from such shock, has recently become more necessary.

As conventional techinical means for buffering such types of shocks in general, there have been known soles that are thick and made of rubber or resin having elasticity, insoles made of elastic materials and soles having an elastic structure of numerous projections provided on the bottom surface of the sole for imparting friction against slip and buffering shocks.

Insoles or shoes having such structure as imparting buffering effects superior to the above conventional art have recently been required.

However, among the conventional insoles for shoes mentioned above, none has addressed concerns a structure to about maintains correct posture or about a structure which may assist persons handicapped, particularly in the legs, when walking in conjunction with an excellent buffering effect.

Also, none of the conventional art has considered how to reduce humidity due to sweating inside shoes.

Further, in the conventional insole, there has been a problem in that the configuration of such insole at the area of the arch of the foot does not fit the inner shape of the shoe, resulting in unexpected distortion of the insole in that area and the arch of the foot of the person wearing the shoes being stressed abnormally.

SUMMARY OF THE INVENTION

Accordingly, one object of the present invention is to provide an insole which is superior in shock buffering effect and reducing quite effectively humidity inside the shoe due to sweating.

Another object of the present invention is to provide an insole which helps people maintain correct posture, has the structure which assists persons handicapped, particularly in the legs, when walking and has an excellent buffering effect.

Still, another object of the present invention is to provide an insole which easily fits the inside structure of the shoe.

In order to attain the above objects, the insole of the present invention is made of resin having elasticity and is increasingly thicker from the arch of the foot to the heel in the bottom of that area, a recess is provided and perforations, as ventilation means, are provided between the bottom of the recess and the upper surface of the insole.

Further, the front area of the insole from the toetip to the arch of the foot, except the thicker portion, is provided with ventilation perforations or holes as ventilation means which are communicated with the recess through grooves provided in the thickness of the insole.

Still further, the insole of the present invention is characterized in that the bottom corner of the heel portion is cut to form a triangular cavity in section surrounded by the upper surface of the sole, the inner side of the cover of the shoe and the cut surface of the heel portion of the insole.

Still further, according to the present invention, the thickness of the insole from the arch of the foot to the heel is formed thicker increasingly toward the heel, so that a slope is made from the heel to the toetip, thereby a person wearing the shoe inserted with this insole is forced to straighten the backbone when walking. And since the posture of the person is inclined forward due to the above inclination, the center of the person's, weight is shifted to the front, which assists the person's paticularly a handicapped person, to take steps forward.

Further, the recess formed in the bottom of the area from the arch of the foot to the heel is provided with the ventilation means formed by being vertically perforated between the bottom of the recess and the upper surface of the insole. Therefore, at each step the thick portion of the area from the arch of the foot to the heel is deformed elastically, thereby changing the capacity of the recess so that a breathing function is generated. This breathing, accompanying a breathing between inside and outside the shoe reduces the humidity inside the shoe. Further, this breathing is generated through the ventilation means provided in the toetip portion of the insole as well, which is communicated with the recess through the grooves provided in the bottom of the insole between said ventilation means and the recess.

Further, due to the cavity formed by the cut-out section of the bottom corner of the insole, (which is formed by being surrounded by the cut surface of the bottom corner of the heel portion, the inner wall of the shoe and the uppermost surface of the sole) when receiving a load from foot at the heel portion, the deformation of the elastic insole into said cavity is not prevented by the inner surface of the shoe. This guarantees a shock buffering effect for protecting heels, knees and the waist, etc., from shock.

Further, the insole is made thin at the area corresponding to the arch of the foot so that when inserted in any shoe available in the market it does not form any unnecessary swelling at the area of the arch of the foot. Therefore, stressing the arch of the foot of a person wearing the shoe is avoided.

DETAILED DESCRIPTION OF THE INVENTION

Figure 1:
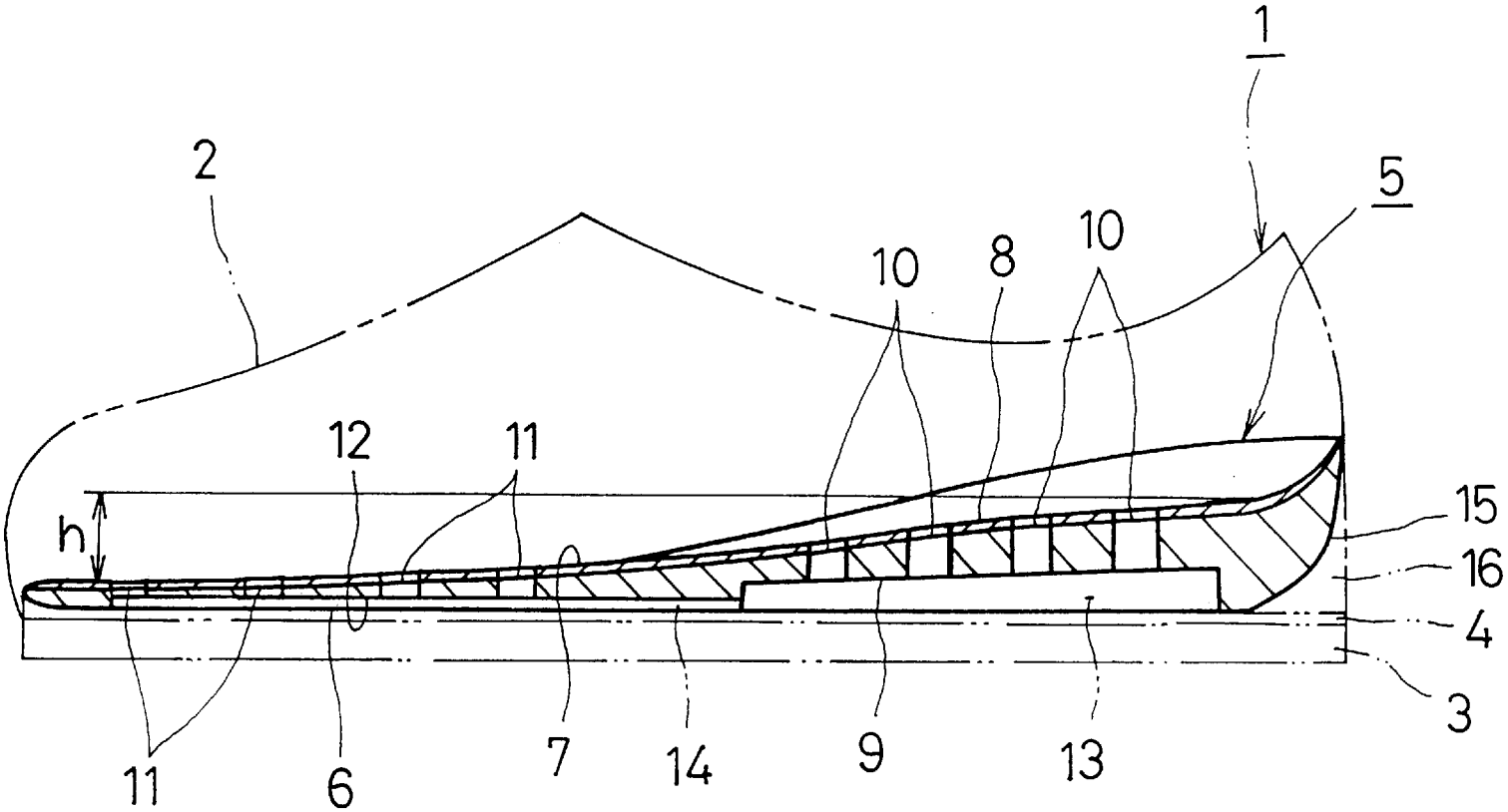
FIG. 1 is a longitudinal side view in section of the insole according to the present invention.
Figure 2:
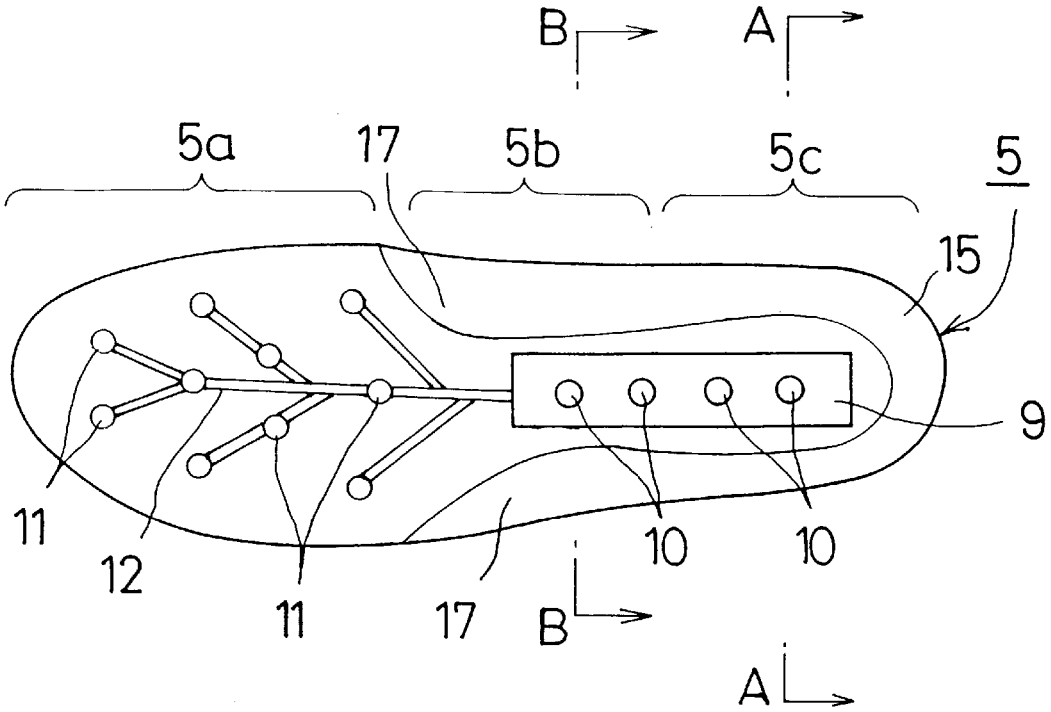
FIG. 2 is a bottom view of the insole according to the present invention.
Figure 3:
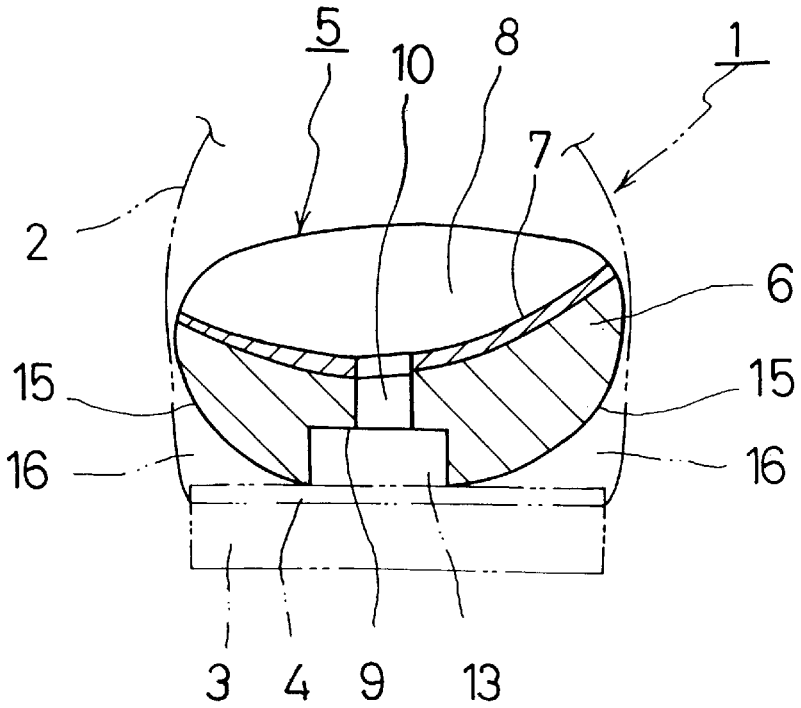
FIG. 3 is an enlarged sectional view along line A—A of FIG. 2.
Figure 4:
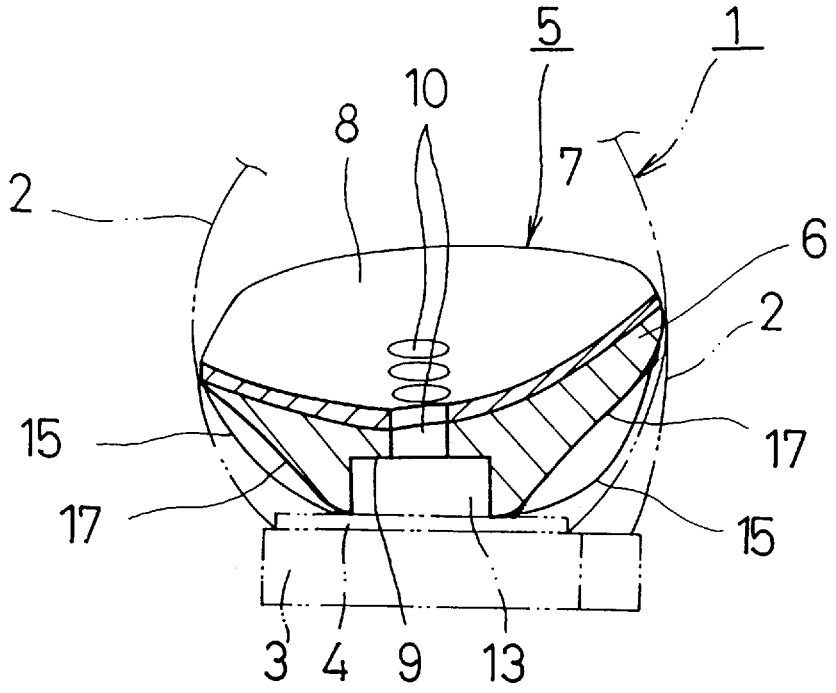
FIG. 4 is an enlarged sectional view along line B—B of FIG. 2.

Referring to FIGS. 1–3, one embodiment of the present invention is explained. Identical numerals in figures designate the identical elelments or corresponding portions.

In FIG. 1 showing a longitudinal side view in section of a shoe into which an insole according to the present invention is inserted, reference numeral 1 designates a shoe available in the market comprising a cover 2 and a sole 3, on which a plain insole 4 is adhered by an adhesive. An insole 5 according to the present invention is used by being inserted into the shoe 1 and placing it on the insole 4.

The body 6 of such insole 5 may be made of an elastic resin such as ethylene vinyl acetate (EVA) foam, and the sole 5 is formed by covering the surface of the body 6 with an air permeable cloth 7.

FIG. 2 shows a bottom view of the insole 5 according to the present invention. The bottom surface is divided, from the front toward the rear, into a toetip portion 5*a*, a portion 5*b* locating at the middle of the sole and corresponding to the arch of the foot and a heel portion 5*c* located at the rear. The toetip portion 5*a* is formed as a thin plate, whole, from the boundary between the toetip portion 5*a* and the arch of the foot portion 5*b* , the thickness of the insole is increased gradually toward the heel portion to make a slope 8. The substantial height h (see FIG. 1) of the heel portion above the toetip portion level is settled in the range of 15–35 mm. The boundary from which the thickness begins to increase is not limited to the afore mentioned boundary, but may be located, for instance, at the center of the arch of the foot portion or at the boundary between the arch of the foot portion and the heel portion.

Further, the substantial height h of the heel portion above the toetip level may be arbitrarily selected depending on the purpose of the shoe or on the necessary buffering function. The configuration of the slope 8 is, as shown in FIG. 3, curved to fit in the bottom of foot.

The bottom of the insole corresponding to the slope 8 of the area of the arch of the foot portion 5*b* and the heel portion 5*c* located at the rear portion of the insole, is provided with a recess 9 extending in the longitudinal direction of the shoe. Further in this embodiment, vertical ventilation holes 10 are perforated as ventilation means between the recess and the upper surface of the insole. In this embodiment, the ventilation holes 10 are shown 4 in number, and are provided in the recess 9 having an even depth. But the number of the ventilation holes 10 is not limited to 4 and the depth of the recess may be changed. Further, in place of the ventilation holes 10, some slits or cut separations as ventilation means may be penetrated through the insole to attain the breathing between the recess 9 and the outside of the insole surface.

As shown in FIG. 2, the toetip portion 5*a* of the insole 5 is provided with ventilation holes 11, which are perforated through such portion, and between such ventilation holes and the recess 9, grooves 12 are provided to communicate air there between. When inserting the insole 5 into a shoe 1 and on the adhered insole 4, the recess 9 forms a space 13 with the upper surface of the insole 4 and the grooves 12 from air channels 14. The space 13 communicates with the inside of the shoe 1 through the ventilation holes 10 and the ventilation holes 11 which intercommunicate through the air channels 12. Further, the grooves 12 are preferably communicated with the space 13.

At the time of walking, the arch of the foot portion 5*b* and the heel portion 5*c* of the insole 5, having elasticity and, increasing in thickness toward the heel portion, are deformed elastically under the load of the person using the shoe. The space 13 is reduced in its capacity under the load when the shoe touches the ground, and the capacity is recovered when the load is removed, thereby enacting a breathing function, which causes to reduce humidity inside the shoe.

Further, in an other embodiment of the present invention, as shown in FIGS. 2 and 3, the bottom corner (in section ) of the area from the arch of the foot portion 5*b* to the heel portion 5*c* of the insole 5 is cut to form a cut-out 15 in such a manner as the sectional width of that area becomes narrower downward. A long cavity 16 is formed thereby (surrounded by the inner wall of the cover 2 of the shoe 1, the insole 4 and the insole 5 (see FIGS. 1 and 3)). The configuration of the cut surface of the bottom corner of the insole 5 may be varied in section, such as linear or curved. When receiving a load during walking, due to the cavity 16, the insole 5 is not prevented from being deformed. In addition, air inside the cavity is compressed instantly by the deformation of the insole 5 to increase the shock buffering effect.

Still further, in the insole of the present invention, the bottom side of the arch of the foot portion 5*b* of the insole 5 is cut out continuously from the cut portion 15 forming another cut-out portion 17. This makes that area thinner for avoiding unnecessary swelling by the overlapping of the arch of the foot portion 5*b* on the inner wall of the cover 2 of the shoe.

In general, any shoe 1 available in the market comprises a narrower sole of the foot to fit a variety of demands in which the arch of the foot is enveloped by the cover 2 of the shoe. The insole 5 according to the present invention inserted into the shoe 1, as shown in FIG. 1, overlaps the arch of the foot portion of the inner wall of the cover 2 at the corresponding arch of the foot portion 5*b* thereof, but due to the cut-out portion 17 the insole 5 does not swell unnecessarily which prevents it from pressurizing the arch of the foot of the person who wears the shoe therefore, so that the insole 5 of the present invention can be applied to any shoe 1.

According to the insole of the present invention, since the thickness of the insole increases from the arch of the foot portion toward the heel portion and thereby the height of the heel portion becomes higher than the toetip portion, the person who wears such shoes is forced to take a posture that straightens the backbone. Further, in using such shoes, there is a tendency of the posture to be inclined forward, which causes the center of weight of the person to be shifted forward. Therefore, it may assist a person to walk, particularly a person having leg injuries or who is handicapped, and has difficulty walking, by forcing that person to take a forward step, thereby reducing tiredness in walking.

Further, since the recess is formed on the bottom of the insole at the area corresponding to the arch of the foot portion and the heel portion and the ventilation means are provided between the recess and the upper surface of the insole, when the insole is deformed elastically while walking, the capacity of the recess is changed. This causes air to flow between the recess and the outside of the shoe in a reciprocating manner through the ventilation means and reduces humidity in the shoes generated by such as sweating of the foot. And, when walking, the ventilation means are instantly covered by the bottom of foot which prevents air from flowing therethrough, so that the shock buffering effect is increased.

Further, the cavity formed by the cut-out of the bottom corner of the heel portion of the insole allows the heel portion to be elastically deformed easily when receiving a load from the foot, whereby a buffering effect can be expected and heels, knees and the waist etc. can be protected from shock generated by stepping.

Since the insole according to the present invention is made thinner at the arch of the foot portion, even if such portion overlaps the arch of the foot portion of the inner wall of the cover of any shoe available in the market it does not cause the arch of the foot portion to swell unnecessarily and avoids pressurizing the arch of the foot of the person who wears the shoe.

What is claimed is:

1. An insole of a shoe, having a perimeter and made of a resin having elasticity, wherein a thickness of the insole increases gradually in a longitudinal direction from an arch portion toward a heel portion to form a sloped section, a recess is provided in a lower surface of the insole in the sloped section, a plurality of ventilation holes penetrate vertically completely through the insole, at least one of the ventilation holes being provided in the recess and other ventilation holes being in communication with the recess through grooves provided in the thickness of the insole, the grooves extending between the other ventilation holes and the recess, and no groove, ventilation hole or recess communicates with the perimeter of the insole, such that a sealed chamber defined by the recess and the grooves is formed in the insole when a foot of a user covers the ventilation holes in an upper surface of the insole to provide a shock buffering effect.

2. An insole of a shoe according to claim 1, wherein a first portion of the plurality of ventilation holes are provided on the area of the insole from a toetip to the arch portion and the first portion of the plurality of ventilation holes and the recess are communicated with each other by the grooves provided in the thickness of the insole.

3. An insole of a shoe according to claim 1, having a first direction perpendicular to the longitudinal direction and parallel to the lower surface of the insole, wherein the heel portion of said insole is cut such that the lower surface of the insole is narrower in the first direction than an upper surface of the insole.

4. An insole of a shoe according to claim 1, having a first direction perpendicular to the longitudinal direction and parallel to the lower surface of the insole, wherein said lower surface of the insole in the arch portion is cut such that the lower surface of the insole is narrower in the first direction than an upper surface of the insole.

5. An insole of a shoe according to claim 1, wherein said resin is ethylene vinyl acetate.

* * * * *